US010736471B2

(12) United States Patent
Wang et al.

(10) Patent No.: US 10,736,471 B2
(45) Date of Patent: Aug. 11, 2020

(54) FOAM SOAP-PROVIDING MACHINE WITH FUNCTION OF RECYCLING SOAP-LIQUID

(71) Applicants: Hsiang-Hung Wang, Lukang Township, Changhua County (TW); Yu-Chang Lin, Lukang Township, Changhua County (TW)

(72) Inventors: Hsiang-Hung Wang, Lukang Township, Changhua County (TW); Yu-Chang Lin, Lukang Township, Changhua County (TW)

( * ) Notice: Subject to any disclaimer, the term of this patent is extended or adjusted under 35 U.S.C. 154(b) by 0 days.

(21) Appl. No.: 16/145,219

(22) Filed: Sep. 28, 2018

(65) Prior Publication Data

US 2020/0100628 A1 Apr. 2, 2020

(51) Int. Cl.

| | |
|---|---|
| ***A47K 5/12*** | (2006.01) |
| ***A47K 5/14*** | (2006.01) |
| *B05B 1/28* | (2006.01) |

(52) U.S. Cl.

CPC ..... *A47K 5/14* (2013.01); *A47K 5/1217* (2013.01); *A47K 2005/1218* (2013.01); *B05B 1/28* (2013.01)

(58) Field of Classification Search

CPC ..... A47K 5/14; A47K 5/1217; A47K 2005/1218; B05B 1/28

See application file for complete search history.

(56) References Cited

U.S. PATENT DOCUMENTS

| | | | | |
|---|---|---|---|---|
| 8,113,389 | B2 * | 2/2012 | Lewis | A47K 5/1205 222/190 |
| 8,672,187 | B2 * | 3/2014 | Ophardt | A47K 5/1217 222/145.5 |
| 8,939,325 | B2 * | 1/2015 | Liang | A47K 5/16 222/190 |
| 9,603,494 | B1 * | 3/2017 | Wang | A47K 5/14 |
| 2011/0114669 | A1 * | 5/2011 | Yang | A47K 5/16 222/52 |

* cited by examiner

*Primary Examiner* — Frederick C Nicolas
(74) *Attorney, Agent, or Firm* — Leong C. Lei

(57) ABSTRACT

A foam soap-providing machine with function of recycling soap-liquid, which comprises: a container containing a soap-liquid and having a soap-releasing portion; a shell-group including at least two detachable shell-bodies combinedly disposed on the outer peripheral surface of the soap-releasing portion; and a faucet mounted on the upper end of the soap-releasing portion and having a soap-feeding portion provided for flowing out the pressurized soap-liquid; wherein the soap-feeding portion has a joint end; wherein a foam-generating module used to generate a foam and a foam-recycling module used to recycle the extruded unused foam are comprised in the shell-group; thereby it can generate foam and recycle the remaining foam in the soap-releasing portion through a single motor. Accordingly, the present invention greatly saves the structural volume and prevents the soap-liquid from being dropped outside and wasted.

4 Claims, 4 Drawing Sheets

FOAM SOAP-PROVIDING MACHINE WITH FUNCTION OF RECYCLING SOAP-LIQUID

TECHNICAL FIELD OF THE INVENTION

The present invention relates to a foam soap-providing machine with function of recycling soap-liquid, and especially relates to a foam soap-providing machine which can generate foam and recycle the remaining foam in the soap-releasing portion through a single motor. Accordingly, the present invention greatly saves the structural volume and prevents the soap-liquid from being dropped outside and wasted.

DESCRIPTION OF THE PRIOR ART

Generally, the personal hygiene can be discussed in many ways. The easiest thing to do for preventing "sickness entered from mouth" is to wash hands.

Considering the factors such as the hygiene in a public place, most manufacturers will not choose soap-type cleaning products. In order to reduce the contact, some manufacturers choose a foam-type soap-providing machine. The main purpose for this type of device is that it can extract the hand-washing liquid or soap-liquid in the container, and then mix the air to form a dense foam.

The conventional foam-type soap-providing machines are mostly operated by two sets of motors, one set of motor extracts the soap-liquid in the container and the other set of motor extracts the outside air; and then the air is mixed with the soap-liquid in the soap-releasing portion of the faucet to form a foam for washing hands; however, such a design has the following defects:

1. Each of the two sets of motors has only a single function, so the design of the two sets of motors takes up too much space to not allow adding new functional equipment.
2. Another problem of the conventional foam-type soap-providing machine is the problem of the soap controlling. Most of the products currently on the market cannot accurately control the extraction of the soap-liquid, resulting in the extraction of too much soap-liquid, which will drip on the sink or wall to make people feel messy and unsanitary, and also cause the waste problem of the hand-washing liquid or soap-liquid.

SUMMARY OF THE INVENTION

The main objective of the present invention is to provide a foam soap-providing machine with function of recycling soap-liquid, which can suck the soap-liquid and air in the container with a single motor, and mix two of them to the soap-releasing portion to provide a foam for hand washing.

The secondary objective of the present invention is to provide a foam soap-providing machine with function of recycling soap-liquid, which a foam-recycling module is set in the machine to recycle the remaining soap-liquid and foam in the soap-releasing portion to reduce waste and keep the environment clean.

The structure which can achieve the above objectives comprises: a container containing a soap-liquid and having a soap-releasing portion; a shell-group comprising at least two detachable shell-bodies combinedly disposed on the outer peripheral surface of the soap-releasing portion; and a faucet mounted on the upper end of the soap-releasing portion and having a soap-feeding portion provided for flowing out the pressurized soap-liquid; wherein the soap-feeding portion has a joint end; wherein a foam-generating module used to generate a foam and a foam-recycling module used to recycle the extruded unused foam are comprised in the shell-group.

Specifically speaking, the foam-generating module comprises a first motor, a liquid-soap releasing-pipeline, and a gas pipeline, wherein the first motor is connected with the liquid-soap releasing-pipeline and the gas pipeline, and the first motor extracts the soap-liquid in the container through the liquid-soap releasing-pipeline; wherein the gas pipeline is used for extracting the external gas and then connecting to the liquid-soap releasing-pipeline by using a three-way joint, and the soap-liquid is mixed with air to form a foam to deliver to the soap-feeding portion for feeding soap.

Accordingly, the first motor can achieve the function of sucking the soap-liquid and guiding the gas, which can allow the foam soap-providing machine to install equipments with new functions, and so as to provide the foam soap-providing machine to have extra functions to improve the cost-performance ratio of the product.

In addition to the above-described design of the foam-generating module, another feature of the present invention is that the foam-recycling module comprises a second motor and a soap-liquid recycling-pipeline, and the second motor is connected with the soap-liquid recycling-pipeline; wherein one side of the soap-liquid recycling-pipeline is disposed at one end of the soap-feeding portion, and the foam remaining in the soap-releasing portion is sucked and recovered into the container through the second motor; so as to recycle the remaining foam in the soap-releasing portion to keep the environment clean and reduce the waste of the soap-liquid.

DETAILED DESCRIPTION OF THE PREFERRED EMBODIMENTS

Figure 1:
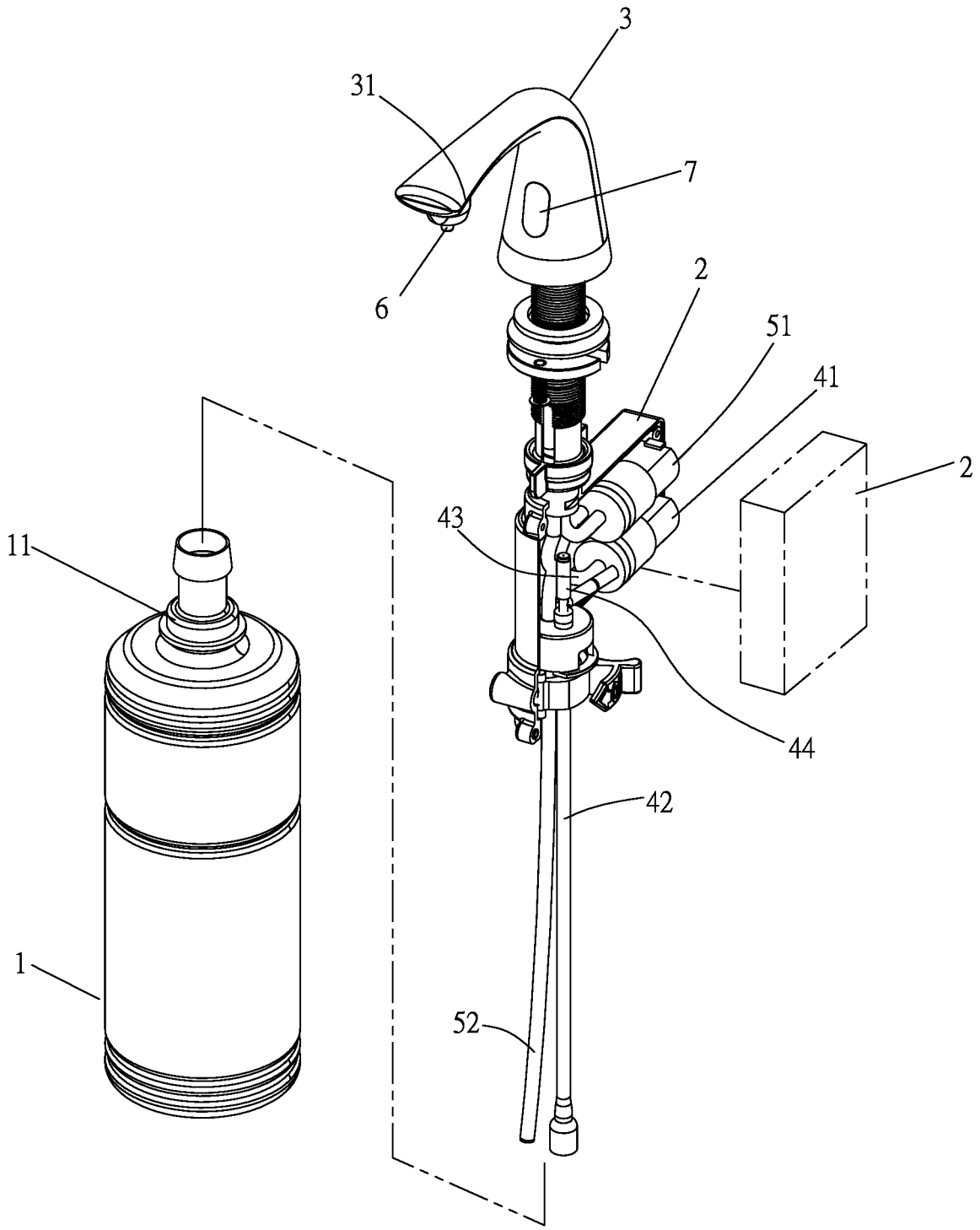
FIG. 1 is a partial cross-sectional perspective view of the present invention.

The following descriptions are exemplary embodiments only, and are not intended to limit the scope, applicability or configuration of the invention in any way. Rather, the following detailed description provides a convenient illustration for implementing exemplary embodiments of the invention. Various changes to the described embodiments may be made in the function and arrangement of the elements described without departing from the scope of the invention as set forth in the appended claims.

The foregoing and other aspects, features, and utilities of the present invention will be best understood from the following detailed description of the preferred embodiments when read in conjunction with the accompanying drawings.

Please refer to FIG. 1 to FIG. 4, the foam soap-providing machine with function of recycling soap-liquid of the present invention mainly comprises: a container 1, a shell-group 2, a faucet 3, a foam-generating module 4, and a foam-recycling module 5.

The container 1 is for containing a soap-liquid (such as a hand-washing liquid, a soap-liquid, a disinfectant), and the container 1 has a soap-releasing portion 11.

The shell-group 2 is composed of two shell-bodies detachably assembled to the outer peripheral surface of the soap-releasing portion 11, and the shell-bodies are used for accommodating the foam-generating module 4 and the foam-recycling module 5.

The faucet 3 is attached to the upper end of the soap-releasing portion 11 and has a soap-feeding portion 31 for allowing the pressurized soap-liquid to flow out; wherein the soap-feeding portion 31 has a joint end 32, as shown in FIG. 1 to FIG. 4, and a foam nozzle 6 is assembled on the joint end 32; wherein the foam nozzle 6 concentrates the mixed foam and then feeds soap, and utilizes the pipeline design of the foam nozzle 6 which is from wide to narrow to increase the pressure, so that the formed foam is more compact and fine.

Figure 2:
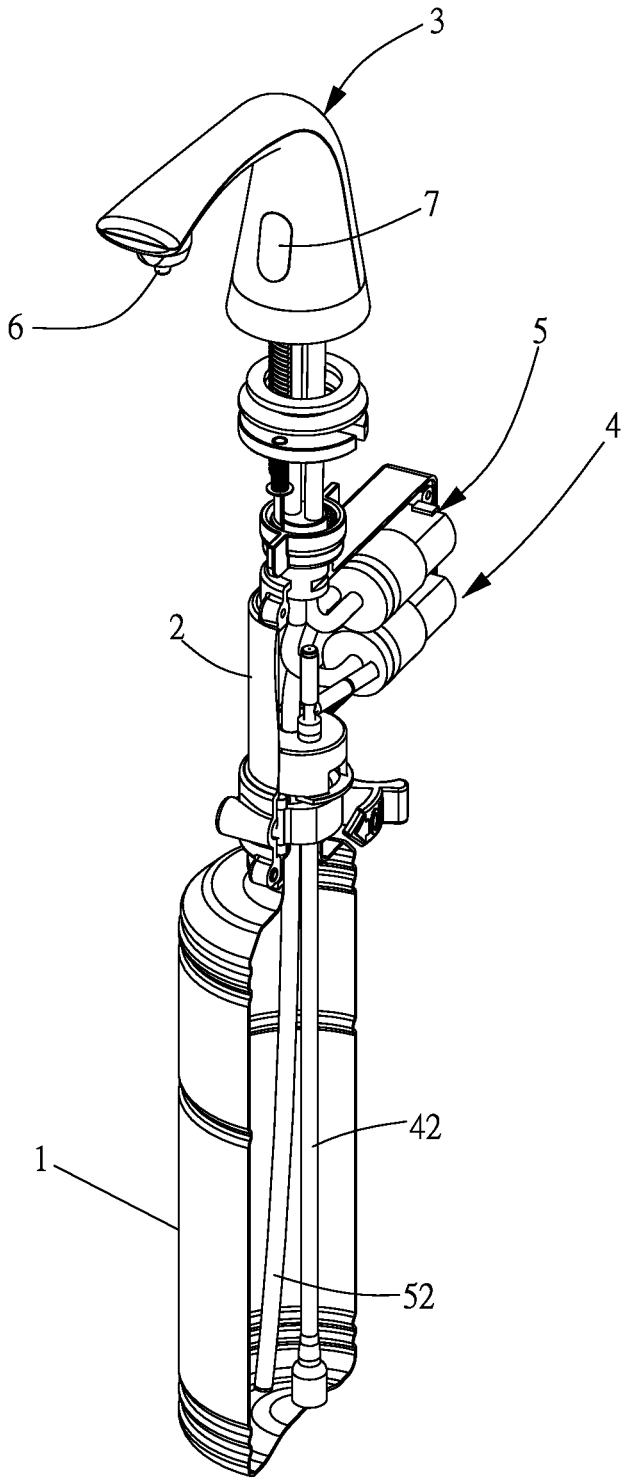
FIG. 2 is a partial cross-sectional perspective view of the assembling state of the present invention.
Figure 3:
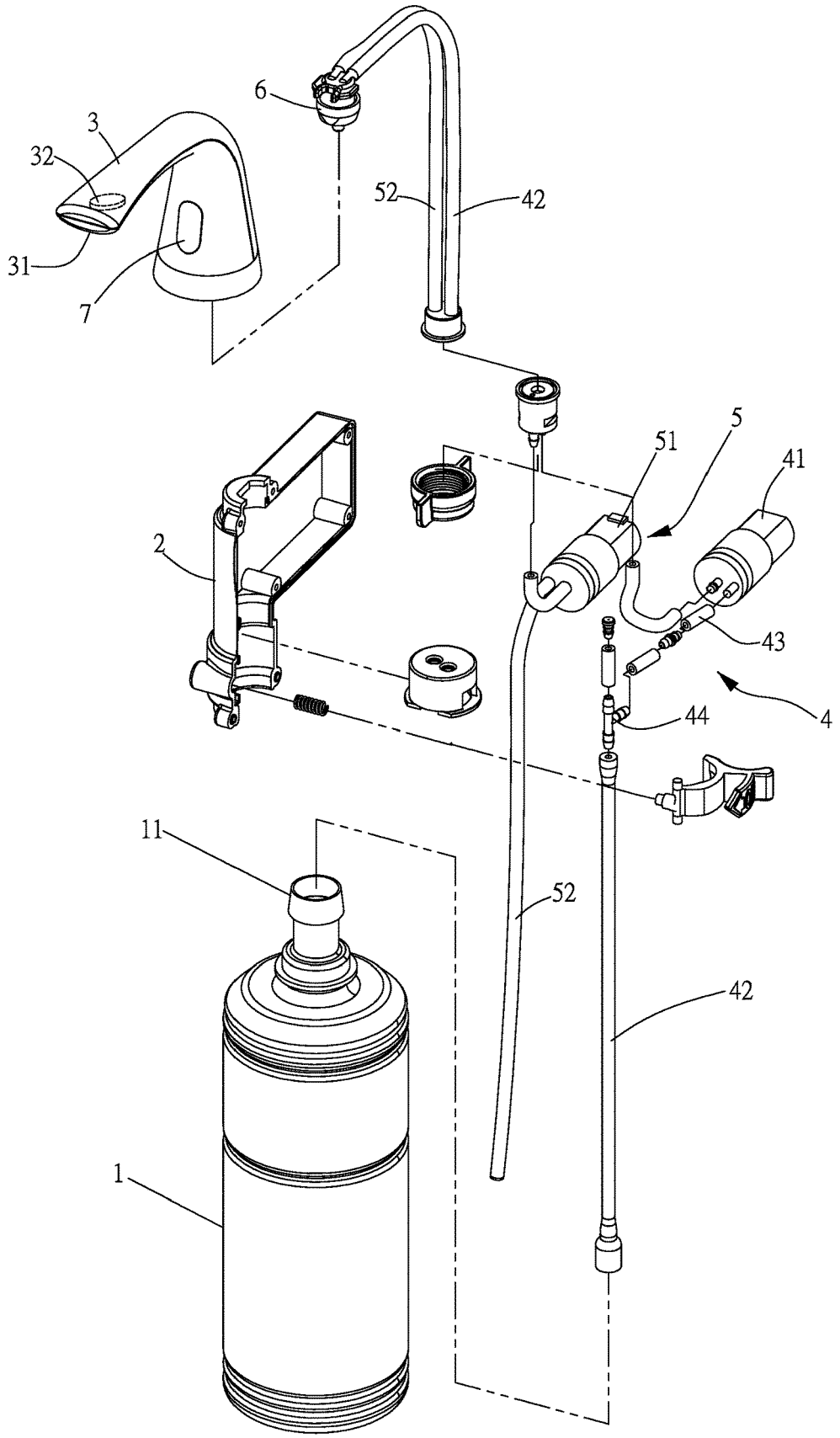
FIG. 3 is a structure exploded perspective view of the present invention.
Figure 4:
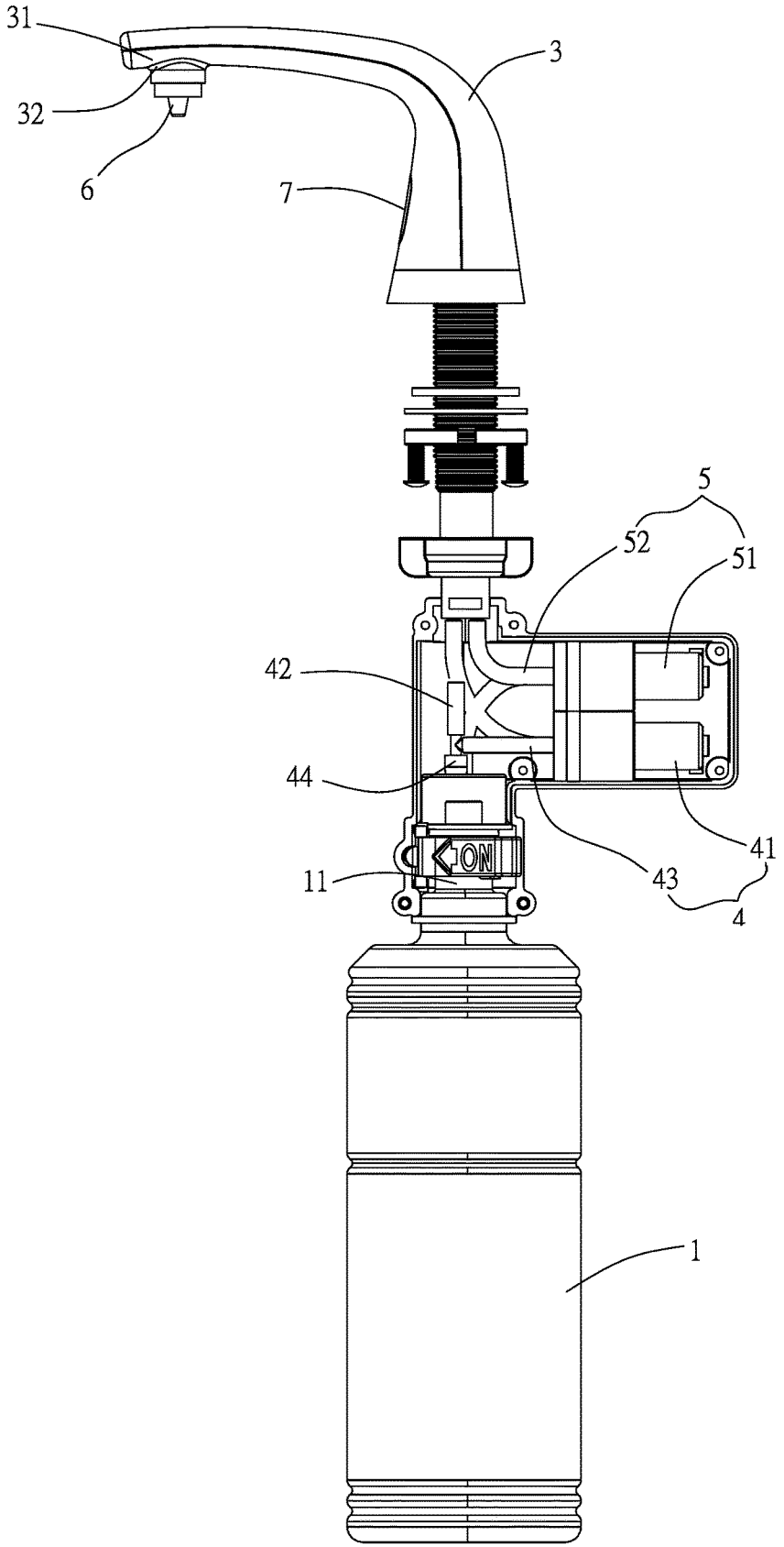
FIG. 4 is a structure cross-sectional view of the present invention.

It is worth mentioning that the faucet 3 is set with a sensing module 7 which can activate the foam-generating module 4 to feed soap when the user's hand is close; and can start the foam-recycling module 5 to recover the soap-liquid when the hand is left. As shown in FIG. 2 to FIG. 4, the foam-generating module 4 is installed in the shell-group 2 for generating foam, and the foam-generating module 4 comprises a first motor 41, a liquid-soap releasing-pipeline 42, and a gas pipeline 43; wherein the first motor 41 is connected with the liquid-soap releasing-pipeline 42 and the gas pipeline 43, and the first motor 41 extracts the soap-liquid in the container 1 from the liquid-soap releasing-pipeline 42 in a partial pressure manner. After the gas pipeline 43 is used to extract the outside air, the gas pipeline 43 is connected to the liquid-soap releasing-pipeline 42 by a three-way joint 44, and the soap-liquid is mixed with air to form a foam to be delivered to the soap-feeding portion 31 to feed soap.

As shown in FIG. 2 to FIG. 4, the foam-recycling module 5 comprises a second motor 51 and a soap-liquid recycling-pipeline 52; wherein the second motor 51 is connected with the soap recovery line 52. One side of the soap-liquid recycling-pipeline 52 is disposed at one end of soap-feeding portion 31, wherein the foam remaining in the soap-releasing portion 11 is sucked and recovered into the container 1 through the second motor 51.

Through the above structure, the methods of use and the acquired efficiencies that can be provided by the present invention are as follows:

1. Soap-feeding mode: when the user's hand is close, the sensing module 7 activates the foam-generating module 4, and the first motor 41 gives partial pressure to suck the soap-liquid in the container 1 and mix with the air; and then the soap-feeding portion 31 or the foam nozzle 6 supplies the user to use the foamed soap-liquid.
2. Recycling mode: after the hand is removed, the sensing module 7 activates the foam-recycling module 5 to suck the soap-liquid or foam remaining in the soap-feeding portion 31 or the pipeline of the foam nozzle 6 through the second motor 51 to reflow into the container 1, so as to save the soap-liquid usage quantum and avoid waste.
3. The foam-generating module 4 can complete the mixing operation of the soap-liquid by dividing the pressure of a single first motor 41, thereby providing the foam soap-providing machine to install equipments with other functions, and so as to greatly improve the economic benefit of the foam soap-providing machine.

We claim:

1. A foam soap-providing machine with function of recycling soap-liquid, which comprises:

a container containing a soap-liquid and having a soap-releasing portion;

a shell-group comprising at least two detachable shell-bodies combinedly disposed on an outer peripheral surface of the soap-releasing portion; and a faucet mounted on an upper end of the soap-releasing portion and having a soap-feeding portion provided for flowing out a pressurized soap-liquid;

wherein the soap-feeding portion has a joint end;

wherein a foam-generating module used to generate a foam and a foam-recycling module used to recycle extruded unused foam are comprised in the shell-group;

which is characterized in that the foam-recycling module comprises a first motor and a soap-liquid recycling-pipeline, wherein the first motor is connected with the soap-liquid recycling-pipeline and one side of the soap-liquid recycling-pipeline is disposed at one end of the soap-feeding portion; wherein the foam remaining in the soap-releasing portion is sucked and recovered into the container through the first motor.

2. The foam soap-providing machine with function of recycling soap-liquid according to claim 1, wherein the foam-generating module is mounted in the shell-group; and the foam-generating module comprises a second motor, a liquid-soap releasing-pipeline, and a gas pipeline; wherein the second motor is connected with the liquid-soap releasing-pipeline and the gas pipeline, and the second motor extracts the soap-liquid in the container through the liquid-soap releasing-pipeline; wherein the gas pipeline is used for extracting an external gas and then connecting to the liquid-soap releasing-pipeline by using a three-way joint, and the soap-liquid is mixed with air to form a foam to deliver to the soap-feeding portion for feeding soap.

3. The foam soap-providing machine with function of recycling soap-liquid according to claim 1, wherein the faucet is set with a sensing module.

4. The foam soap-providing machine with function of recycling soap-liquid according to claim 1, wherein the joint end is assembled with a foam nozzle to concentrate a mixed foam, and then to feed soap.

* * * * *